United States Patent [19]

Hornbuckle

[11] 3,931,941

[45] Jan. 13, 1976

[54] PNEUMATICALLY OPERATED SWIFT FOR HOLDING SKEINS OF YARN TO BE UNWOUND VERTICALLY

[75] Inventor: Hal E. Hornbuckle, Mount Holly, N.C.

[73] Assignee: Belmont Textile Machinery Co., Inc., Mount Holly, N.C.

[22] Filed: Sept. 30, 1974

[21] Appl. No.: 510,457

[52] U.S. Cl. ..... 242/110

[51] Int. Cl.[2] ..... B65H 75/24

[58] Field of Search..... 242/110, 110.1, 110.2, 242/110.3, 115, 72 R, 53; 269/48.1; 279/2 A, 4

[56] References Cited

UNITED STATES PATENTS

| | | | |
|---|---|---|---|
| 1,917,872 | 7/1933 | Campbell | 279/4 |
| 2,600,840 | 6/1952 | Bruegger | 242/110.2 |

*Primary Examiner*—Leonard D. Christian

[57] ABSTRACT

A pneumatically operated swift for holding skeins of yarn to be unwound vertically that includes expandable and contractable skein holding arms carried by a tubular center post, a plunger is disposed within the tubular center post for vertical movement therein, means are carried by the plunger for engaging a pressure ring on the center post, said means being a cross pin disposed through guide slots in the center post so that the pressure ring can move upwards to expand the skein holding arms and air actuated cylinder and piston means for moving said plunger upwardly. The swift further includes a yarn ring having a solid center post removably engaged within the upper end of the tubular center post and which solid center post is elevated vertically by additional plunger means so as to raise the yarn ring as the skein holding arms expand outwardly.

2 Claims, 2 Drawing Figures

PNEUMATICALLY OPERATED SWIFT FOR HOLDING SKEINS OF YARN TO BE UNWOUND VERTICALLY

BACKGROUND OF THE INVENTION

The present invention relates broadly to the art of winding and reeling. More particularly this invention relates to a swift for holding skeins of yarn to be unwound vertically onto a package suitable for carpet tufting, beaming, weaving, knitting and other textile finishing machinery.

Devices of this character are known in the art but are generally arranged horizontally. Horizontal swifts have to be loaded by hand or by a machine and then placed onto a winder or take-up machine. The machine then has to pull the swift, rotating it and thus limiting the speed of operation, causing excess tension and at all times rotating the entire skein of yarn.

A swift arranged on a vertical axis for use in unwinding coils of wire is shown in U.S. Pat. No. 1,122,812 to Somerville. However, the coil support bars or arms are expandable under the action of centrifugal force. U.S. Pat. No. 2,600,840 discloses a foldable reel disposed on a vertical axis and having expandable arms that are urged outwardly by spring means.

Accordingly, the present invention provides a vertical swift having skein supporting arms that are expandable under the action of pneumatically operated plunger means and which arms can move to retracted position upon release of the pressure acting on such plunger means.

STATEMENT OF THE INVENTION

Thus the vertical swift of the invention includes a base, a hollow or tubular center post extending upwardly therefrom vertically spaced collars secured to a sleeve on the center post, a plurality of skein supporting arms connected by vertically spaced sets of links to the collars and movable between extended and retracted relation relative to the center post and a foot-controlled pneumatically actuated plunger means and a cooperable, axially shiftable, pressure applying ring for engaging the lower set of links to expand the skein supporting arms.

In addition, a yarn ring is mounted on top of the swift to allow the end of the yarn to pull free and not rest against the skein of yarn as the arms extend outwardly. The yarn ring is readily removable and a loading cap or cone is provided at the top of the center post to facilitate loading of skeins on the swift.

Further, the yarn ring is arranged to be lifted vertically as the skein is unwound to allow the yarn to clear the top of the arms and to maintain approximately the same tension throughout the unwinding.

Specifically in the swift of this invention the pneumatically actuated plunger means includes a pressure ring plunger that is shiftable vertically within the center post, and which plunger carries a transversely disposed pin that projects through vertical slots in the center post. This pin is engaged beneath a pressure ring that is so correlated with the lower set of links that as the plunger moves upwards the pressure ring forces the lower links to swing outwardly thus urging the arms to expand. The arms holding the skein have pressure applied thereto at all times by the pressure in the air cylinder so as to keep the skein in the proper configuration and under the correct tension so as to unwind properly. The amount of pressure applied to the yarn is controlled by a suitable air pressure regulator. In this regard, various pressures may be required depending on the size of the yarn. Also, long or short arms are adaptable to the swift to accommodate various widths of skeins.

Further and more specific objects and advantages of the invention will be more readily apparent from the following description when taken in connection with the accompanying drawings.

DETAILED DESCRIPTION OF A PREFERRED EMBODIMENT

Figure 1:
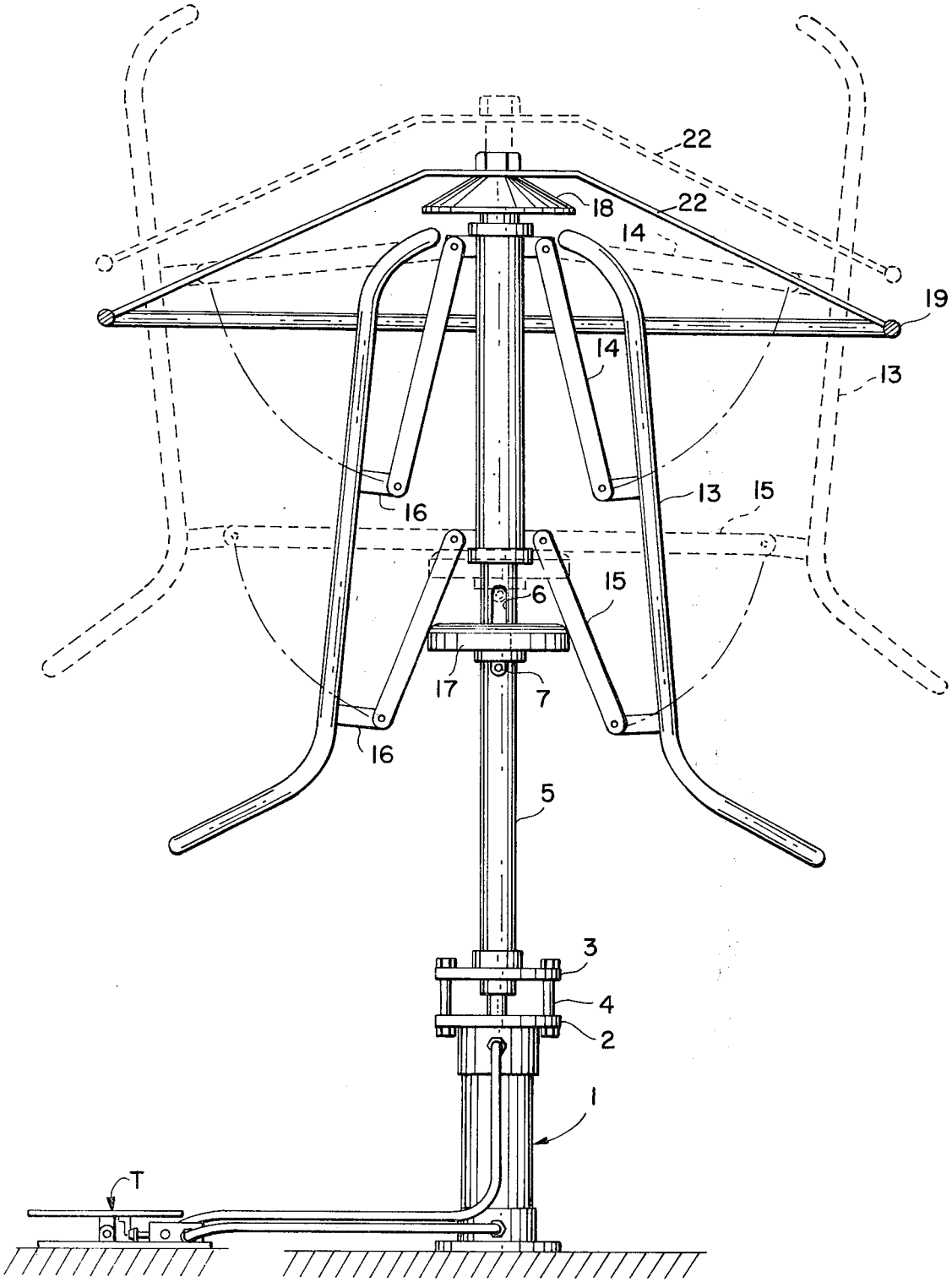
FIG. 1 is a side elevational view of a vertical swift constructed in accordance with the invention and with the skein supporting arms illustrated in their retracted position in full lines and in their expanded position in dotted lines.
Figure 2:
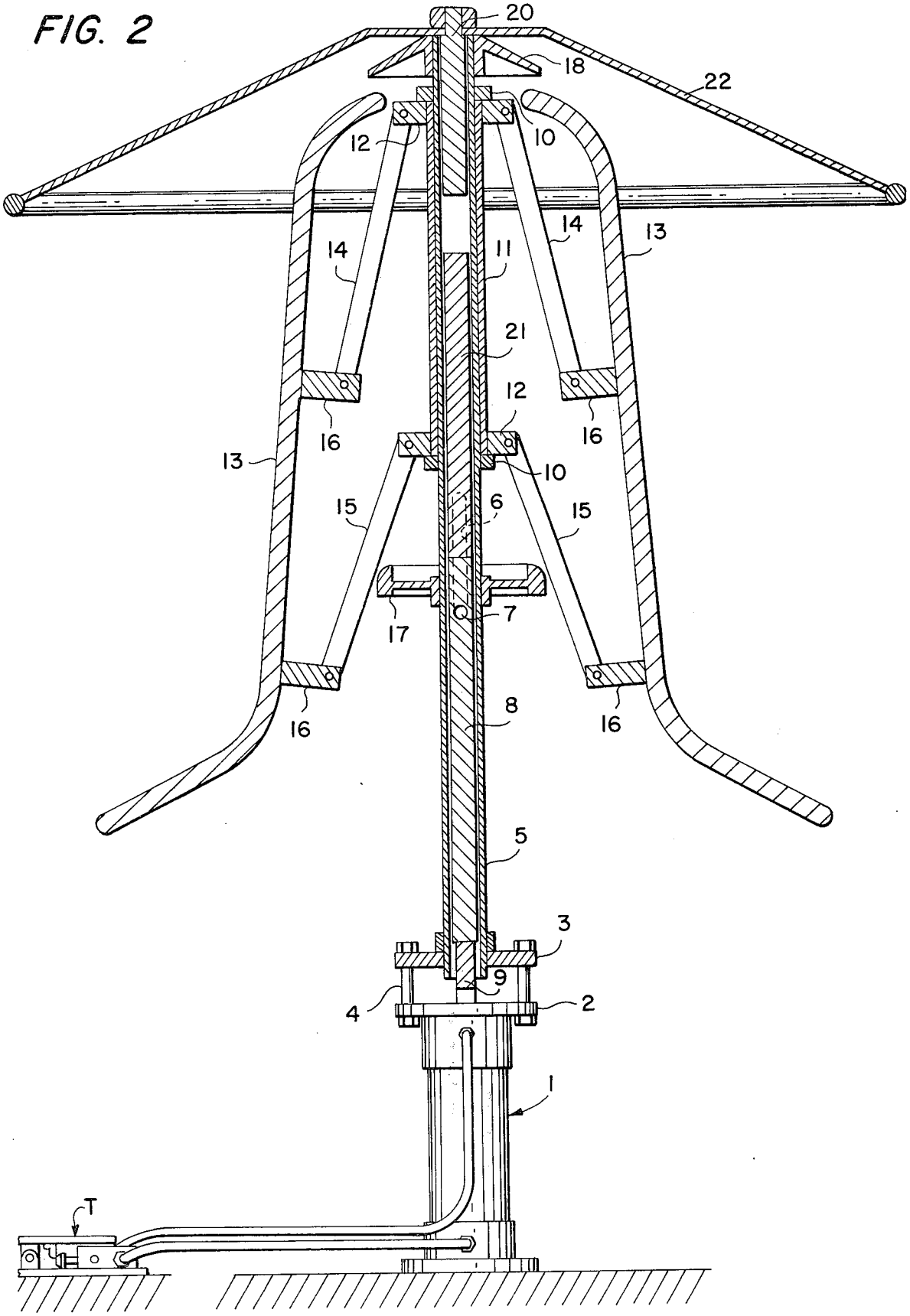
FIG. 2 is a longitudinal sectional view of the arrangement shown in FIG. 1.

The vertical swift of the invention includes an upright air cylinder 1 to the top of which is secured an apertured plate 2. A center post base 3 is connected to plate 2 by means of a set of adjusting studs 4. The center post 5 is tubular and is secured within a central aperture in the base 3. Further, the center post is provided with oppositely disposed guide slots 6 that accommodate a cross pin 7 secured to a plunger 8 disposed within the center post. The plunger 8 is displaced vertically upwards by a plunger 9 actuated by the piston in the air cylinder. Vertically spaced bearing collars 10 are arranged on the center post to rotatably support a sleeve 11 that surrounds an upper portion of the center post. Rings or collars 12 are secured to the upper and lower ends of the sleeve 11. A plurality of skein supporting arms 13, in one example, there being six circumferentially equi-spaced arms, are connected to the collars 12 by upper and lower sets of links 14 and 15. The inner ends of each link being pivotally connected to the rings or collars 12 and the outer ends of each link are pivotally connected to short brackets or supports 16 carried on the inner side of each arm 13.

A pressure ring 17 is slidably disposed on the center post above the cross pin 7. This pressure ring is so correlated with the lower set of links 15 that as the plunger 8 is moved upwardly the cross pin carries the pressure ring upwardly to engage the inner sides of the lower links 15 to force them outwards. As these links move outwards the upper links 15 also move outwards so that the arms are expanded to the dotted line position in FIG. 1.

A loading cap or cone 18 is secured to the top of the center post and a yarn supporting ring 19 is connected by one cross bar 22 to a yarn ring center post 20 that fits within the open upper end of the center post.

A further plunger 21 is disposed within the center post above plunger 8 for engaging the yarn ring center post 20 to displace the yarn ring upwardly as the arms 13 expand.

In utilizing the vertical swift of the invention, the yarn ring 19 is removed, the skein of yarn is placed onto the swift over the loading cap or cone 18, the skein supporting arms 13 being fully retracted under the loading cap 18 allowing the skein to be loaded in one easy motion. The yarn ring is then replaced and the operator actuates the treadle T to admit air under pressure into the lower end of the air cylinder 2. The piston therein moves upwardly to cause plunger 9 to push plunger 8 upwards so that the cross pin 7 lifts pressure applying ring 17 upwards to push lower links outwards and upwards, moving the skein supporting arms 13 inside the skein of yarn as the yarn is unwound, the skein getting larger in internal circumference and pressure being applied to the skein at all times. The plunger 8 in moving upwardly carries with it plunger 21 which in turn engages the yarn ring center post 20 to lift the yarn ring vertically to maintain the same angle and tension throughout the unwinding.

When all the yarn is wound off, the treadle is actuated again to allow the arms 13 to retract under the loading cap or cone so that the next skein can be placed onto the swift with a minimum of effort.

Since the arms 13 are pivoted to the collars 10 carried by sleeve 11 the arms and skein can be turned or rotated about the center post so that the operator can remove the tie bands without moving around the unit.

What is claimed is:

1. A pneumatically operated swift for holding skeins of yarn to be unwound vertically comprising a base, a tubular center post extending upwardly therefrom, a series of skein supporting arms spaced around said center post, a sleeve carried by said center post for turning movement thereabout, upper and lower sets of linkage means connecting said arms to said sleeve so that said arms can expand and retract relative to said center post, pneumatically operated pressure applying means cooperably related with said lower set of linkage means for moving the same to expand said arms, said pressure applying means including a pressure applying ring slidably mounted on said center post beneath the connection of said lower set of links with said sleeve, said center post having oppositely arranged guide slots therein, a plunger within said center post, a cross pin on said plunger having end portions extending through said slots and engaging said pressure applying ring and air actuated cylinder and piston means operably related with said plunger to lift the same to cause said pressure applying ring to engage said lower set of links to move the same outwards and upwards to expand said skein supporting arms.

2. A pneumatically operated swift as claimed in claim 1 and further including a yarn ring, a yarn ring center post, means connecting said yarn ring to said yarn ring center post, said yarn ring center post being removably insertible into said tubular center post, another plunger within said center post and engaged by said first mentioned plunger, said another plunger engaging said yarn ring center post to lift the same and thereby said yarn ring as said skein supporting arms expand outwards responsive to upward movement of said first mentioned plunger and pressure applying ring.

* * * * *